US005222820A

United States Patent [19]

Kamei et al.

[11] Patent Number: 5,222,820

[45] Date of Patent: Jun. 29, 1993

[54] METHOD AND APPARATUS FOR IMPROVING PAPER HANDLING IN A PRINTER

[75] Inventors: Yuichi Kamei, Musashino; Osamu Hinishi, Tanashi, both of Japan

[73] Assignee: Citizen Watch Co., Ltd., Tokyo, Japan

[21] Appl. No.: 809,624

[22] Filed: Dec. 17, 1991

[30] Foreign Application Priority Data

Dec. 20, 1990 [JP] Japan ..... 2-411791

[51] Int. Cl.[5] ..... B41J 13/10

[52] U.S. Cl. ..... 400/645; 400/645.5; 400/708; 400/320

[58] Field of Search ..... 400/279, 642, 645, 645.5, 400/708, 320

[56] References Cited

U.S. PATENT DOCUMENTS

| | | | |
|---|---|---|---|
| 4,775,254 | 10/1988 | Nakao et al. | 400/279 |
| 4,781,478 | 11/1988 | Eguchi | 400/279 |
| 4,802,778 | 2/1989 | Takahashi et al. | 400/642 |

FOREIGN PATENT DOCUMENTS

| | | | |
|---|---|---|---|
| 62-64588 | 3/1962 | Japan . | |
| 56579 | 4/1985 | Japan | 400/642 |
| 62-41148 | 2/1987 | Japan . | |
| 178372 | 8/1987 | Japan | 400/642 |
| 1-129167 | 5/1989 | Japan . | |
| 2203700 | 10/1988 | United Kingdom | 400/642 |

*Primary Examiner*—Edgar S. Burr
*Assistant Examiner*—Stephen R. Funk
*Attorney, Agent, or Firm*—Lowe, Price, LeBlanc & Becker

[57] ABSTRACT

A sheet guide apparatus for a printer comprises a printing head, a platen arranged in opposed relation to the printing head, sheet feed tractor arranged upstream of the platen in a sheet delivering direction, a plurality of guide elements arranged downstream of a delivering direction of a sheet passing between the printing head and the platen, along an axis of the platen with the guide elements spaced from a surface of the platen, wire rope and pulley system for moving the printing head axially of the platen, and control unit for controlling the wire rope and pulley system such that, after a forward end of the sheet transported by the sheet feed tractor has been abutted against sheet engaging surfaces of the respective guide elements, the printing head is reciprocated along the platen axis.

6 Claims, 7 Drawing Sheets

METHOD AND APPARATUS FOR IMPROVING PAPER HANDLING IN A PRINTER

BACKGROUND OF THE INVENTION

1. Field of the Invention

The present invention relates to an improvement in a sheet guide apparatus for a printer.

2. Description of the Prior Art

There are necessities that a sheet inserting opening and a sheet discharge opening are provided respectively at both sides to improve operability of a printer, and an arrangement of the printer is miniaturized. In view of such necessities, as disclosed in Japanese Patent Laid-Open No. 41148/1987 and Japanese Patent Laid-Open No. 129167/1989, there are many arrangements in which a transporting path for a printing sheet of paper in a printer is bent along an outer peripheral surface of a platen at a section from the sheet inserting opening to a printing position on a platen and a section from the printing position on the platen to the sheet discharge opening.

FIG. 7 of the attached drawings shows a sheet guide mechanism for a printer disclosed in Japanese Patent Laid-Open No. 41148/1987. A printing sheet of paper 100 inserted in a direction indicated by an arrow a from a sheet inserting opening has a forward end which is pressed or retained by a guide plate 101 provided with a friction roller 102 and a sheet retainer 103 and which is bent along an outer peripheral surface of a platen 105. By rotation of the platen 105, the forward end of the printing sheet of paper 100 is introduced or guided to a printing position which is defined at a gap between a printing head 104 and the platen 105. Further, the forward end of the printing sheet of paper 100 is restricted in path by a plurality of guide elements 107 which are arranged axially of the platen 105. The forward end of the printing sheet of paper 100 is clamped between a bail roller 108 and an abutment element 109 and is discharged downstream at an upper location.

However, at the time the printing sheet of paper 100 bent along the outer peripheral surface of the platen 105 is introduced to the printing position defined at the gap between the printing head 104 and the platen 105, restricting or restraining forces due to the guide plate 101 and the sheet retainer 103 are removed. Accordingly, the forward end of the bent printing sheet of paper 100 is bent backward in a counterclockwise direction in FIG. 7 by a restoring force of the printing sheet of paper 100 per se. The forward end of the printing sheet of paper 100 is caught by a top **107*b* of the guide element 107, or projects toward the printing head 104 beyond the guide element 107. Thus, there is a case where the guide element 107 interferes with insertion of the printing sheet of paper 100**.

Particularly, in the case where the printing sheet of paper 100 is thick, the restoring force of the forward end thereof is strong or large. Both ends **100*a* of the forward end of the sheet of paper 100, which are not supported by the printing head 104, are largely moved apart away from the platen 105, as shown in FIG. 8, and are caught by the top of the guide element 107. Thus, insertion of the printing sheet of paper 100** will become very difficult.

SUMMARY OF THE INVENTION

It is an object of the invention to provide a sheet guide apparatus for a printer, which can resolve the above-discussed problems of the prior art, and in which, even in the case where a thick printing sheet is inserted, inserting operation of the printing sheet can be made simply and reliably without a forward end of the printing sheet being caught by a guide element at a sheet discharge opening.

According to a sheet guide apparatus for a printer of the invention, sheet feeding is once stopped or halted under a condition that a forward end of a printing sheet passing through a location between a printing head and a platen is abutted against sheet engaging surfaces of respective guide elements arranged at a location corresponding to the printing head, or is fed at a low speed, and various portions of the forward end of the printing sheet are successively engaged with the sheet engaging surfaces of the respective guide elements while being successively urged against an axial direction of the platen. Accordingly, it is prevented that the forward end of the printing sheet tends to be bent backward toward the printing head by a restoring force of the printing sheet having one end thereof bent along an outer peripheral surface of the platen interferes with tops of the respective guide elements arranged at an opening adjacent to the printing head, and projects toward the printing head. Thus, even in the case where a thick printing sheet is used, it is possible to easily and certainly execute insertion operation of the printing sheet.

A sheet guide apparatus for a printer according to the invention comprises a printing head, a platen, sheet transporting means, a plurality of guide elements arranged downstream of a sheet passing between the printing head and the platen, along an axis of the platen with the guide elements spaced from a surface of the platen, printing-head moving means for moving the printing head axially of the platen, and drive control means for controlling the printing-head moving means such that, after a forward end of the sheet transported by the sheet transporting means has been abutted against sheet engaging surfaces of the respective guide elements, the printing head is once reciprocated along the axis of the platen.

When printing is commanded after the forward end of the printing sheet bent along the outer peripheral surface of the platen has been introduced to a gap between the printing head and the platen and has been abutted against a stopper, the printing head located at a home position at a left-hand end advances toward a center portion of the platen in the longitudinal direction thereof and stops or is halted, the sheet is successively transported, and the forward end of the printing sheet supported by the printing head stops at a location where the forward end of the printing sheet is abutted against the sheet engaging surface of the guide element arranged substantially at a center portion of a sheet discharge opening adjacent to one side of an opening adjacent to the printing head.

The printing sheet is fed out toward a downstream side from a gap between the printing head and the platen. The printing-head moving means is controlled such that the drive control means once reciprocates the printing head along the axis of the platen under a condition that the forward end of the printing sheet is abutted against the guide elements. The various portions of the forward end of the printing sheet are urged toward the platen by the moving printing head. The various portions of the forward end of the printing sheet are successively engaged with the sheet engaging surfaces of the respective guide elements.

DETAILED DESCRIPTION OF THE PREFERRED EMBODIMENTS

Figure 1:
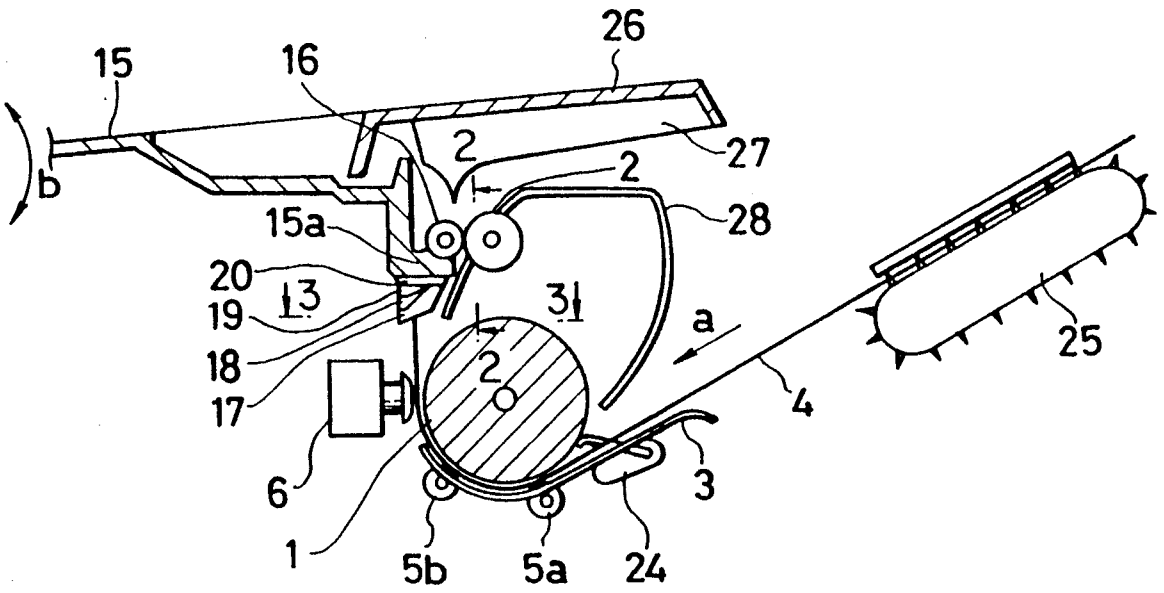
FIG. 1 is a cross-sectional side-elevation view showing a principal portion of a sheet guide apparatus for a printer according to an embodiment of the invention.
Figure 5:
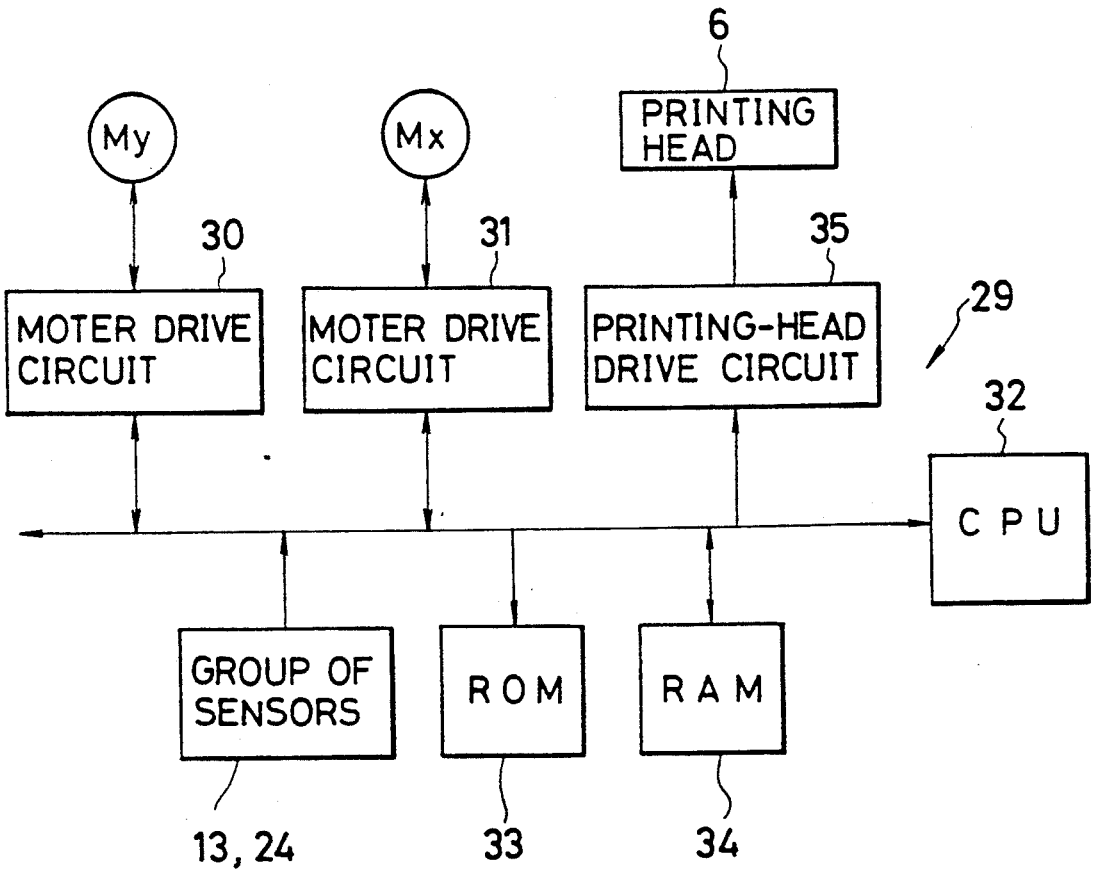
FIG. 5 is a block diagram of drive control means in the sheet guide apparatus illustrated in FIG. 1.

Referring first to FIG. 1, there is shown a platen 1 and a bail roller 2 both of which are supported by a printer body, and which are rotatably driven in a sheet feed direction by a sheet feed motor $M_y$ (refer to FIG. 5). A peripheral speed of the bail roller 2 is slightly faster than a peripheral speed of the platen 1. A guide plate 3 formed along an outer peripheral surface of the platen 1 is arranged below the platen 1. A printing sheet of paper 4 inserted from a sheet inserting opening in a direction a has a forward end which is clamped between the platen 1 and a pair of friction rollers 5*a* and 5*b*. The printing sheet of paper 4 is transported by rotation of the platen 1, and is guided along the guide plate 3. The printing sheet of paper 4 is bent along the outer peripheral surface of the platen 1, and is introduced into a gap between a printing head 6 and the platen 1.

Figure 3:
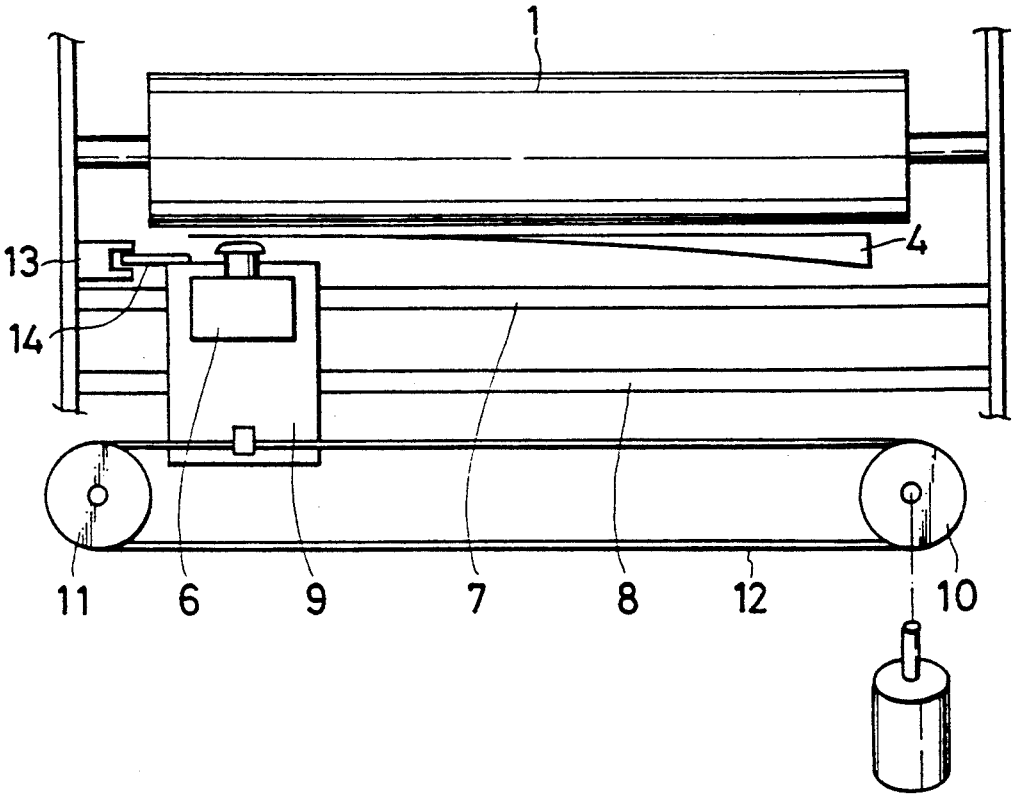
FIG. 3 is a top plan view showing a portion of the arrangement illustrated in FIG. 1, as viewed from the line B—B in FIG. 1.

As shown in FIG. 3, the printer body has a pair of guide shafts 7 and 8 which extend in parallel relation to the platen 1. A slidable carriage 9 is mounted on the guide shafts 7 and 8, and the printing head 6 is mounted on the carriage 9. A wire rope 12 is secured on the carriage 9 serving as printing-head moving means. The wire rope 12 extends between and passes about a drive pulley 10 and a driven pulley 11. A motor $M_x$ mounted to the drive pulley 10 is driven whereby the carriage 9 is moved on the guide shafts 7 and 8 along a platen axis in accordance with rotation of the pulley 10. A home position of the printing head 6 is located at a left-hand end of the platen 1 in a longitudinal direction thereof. A home-position sensor 13 arranged at a left-hand end of the printer body and a shutter blade 14 in the form of a plate fixedly mounted on the carriage 9 are engaged with each other, whereby the home position of the printing head 6 is detected.

Figure 2A:
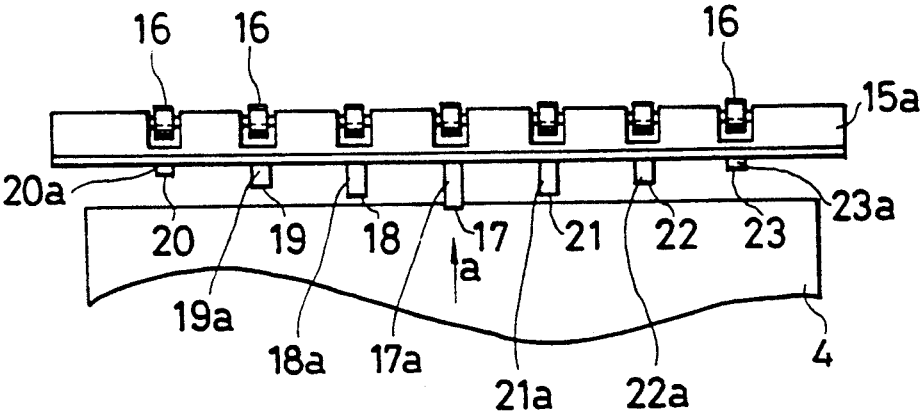
FIG. 2A is a rear view showing a portion of an arrangement illustrated in FIG. 1, as viewed from the line A—A in FIG. 1.

A top cover 15 is mounted on the printer body so as to be capable of being opened and closed in a direction indicated by an arrow b in FIG. 1. The top cover 15 has a plurality of driven rollers 16 at a position where the driven rollers 16 are engaged with the bail roller 2 at a location adjacent to the printer body. The driven rollers 16 cooperate with the bail roller 2 to clamp therebetween the sheet of paper 4. Further, as shown in FIG. 2A, the top cover 15 has a forward edge 15*a*, and a plurality of guide elements 17 ~23 are arranged below the forward edge 15*a* of the top cover 15. The guide elements 17~23 have their respective sheet engaging surfaces 17*a*~23*a* generally in the form of an arc which extend along the outer peripheral surface of the platen 1. The guide elements 17~23 are formed such that an amount of projection of the guide element 17 corresponding to a center position of the platen 1 in the longitudinal direction thereof is the largest. Hereinafter, amounts of projection become gradually small or are gradually reduced with respect to the guide elements 18, 21, 19, 22, 20 and 23, in accordance with a distance from the guide element 17.

Figure 2B:
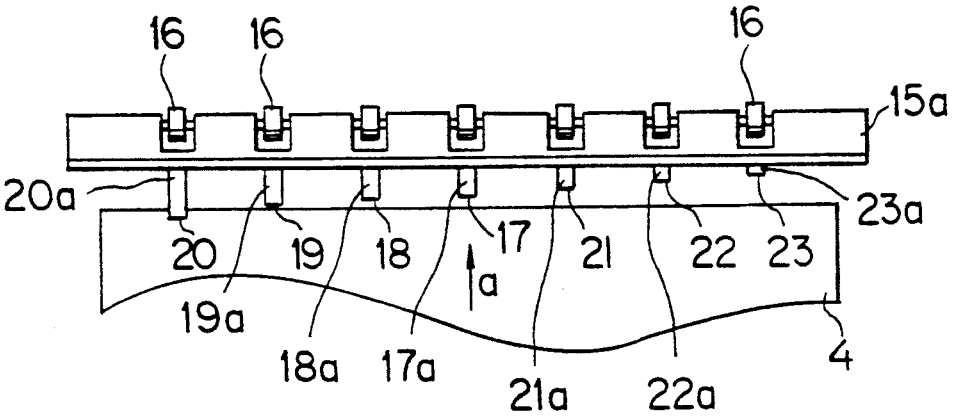
FIG. 2B is a rear view of an alternative embodiment of the arrangement shown in FIG. 2A.

FIG. 2B shows an alternative embodiment of the arrangement of the guide elements 17–23. Guide elements 17–23 are formed such that a guide element 20 nearest one of the sides of platen 1 is the largest. The remaining guide elements 17, 18, 19, 21, 22, 23 are gradually reduced in size with distance from guide element 20, so that guide element 23 farthest from guide element 20 is smallest.

The reference numeral 24 in FIG. 1 denotes a sheet detecting sensor for detecting the forward end of the inserted printing sheet of paper 4. Moreover, the reference numeral 25 denotes a continuous-sheet feed tractor which serves as sheet transporting means arranged upstream of the platen 1. When a cut sheet is inserted, the continuous-sheet feed tractor 25 is removed from a transporting path for the sheet of paper 4.

The printing sheet of paper 4, which is clamped between the platen 1 and the friction rollers 5*a* and 5*b*, which is transported thereby and which projects, is clamped between the bail roller 2 and the driven rollers 16 and is transported thereby. The sheet of paper 4 passes between a sheet guide rib 27 formed inwardly of a noise cover 26 mounted on the top cover 15 for opening and closing, and a paper guide 28 adjacent to the printer body, and is discharged to the outside of the printer.

FIG. 5 is a block diagram showing a principal portion of a control unit 29 for the printer, which serves also as drive control means for the sheet guide apparatus. The sheet feed motor $M_y$ and a head feed motor $M_x$ are connected to a microprocessor (hereinafter referred to as "CPU") 32 of the control unit 29 through respective motor drive circuits 30 and 31. The sheet feed motor $M_y$ and the head feed motor $M_x$ are stepping motors. Present-position storing registers, which store present positions of the respective motor shafts in a non-volatile manner, are mounted respectively on the motor drive circuits 30 and 31.

Further, a ROM 33 which stores therein a drive control program for the printer or the like, and a RAM 34 used for temporary memory or storage of data, as well as a group of sensors such as the home-position sensor 13 for detecting the home position of the printing head 6, the sheet detecting sensor 24 and the like are connected to the CPU 32. Furthermore, a ROM is provided which stores therein a number of pulses $N_C$ required to move the printing head 6 from the home position to a center portion of the platen 1 in the longitudinal direction thereof, a number of pulses $N_R$ required to move the printing head 6 from the home position to the right-hand end of the platen 1, a number of pulses $N_t$ required to move the forward end of the printing sheet of paper 4 abutted against the friction roller 5a from the direction indicated by the arrow a, to a position where the forward end of the printing sheet of paper 4 is abutted against the guide element 17, and a number of pulses $N_F$ required to move the printing sheet of paper 4 abutted against the friction roller 5a, to a printing position of the first line. Moreover, stored in the ROM are a number of pulses $N_t$, required to move the forward end of the printing sheet of paper 4 located at the sheet detecting sensor 24, to the abutment position where the forward end of the printing sheet of paper 4 is abutted against the guide element 17, and a number of pulses $N_F$, required to move the printing sheet of paper 4 located at the sheet detecting sensor 24, to the printing position of the first line.

A printing-head drive circuit 35 arranged between the printing head 6 and the CPU 32 is provided for controlling, in excitation, the printing wires of the printing head 6 on the basis of a command from the CPU 32. However, printing operation due to the wires, printing control of a character generator, and the like are known well, and are not described here particularly.

Figure 6:
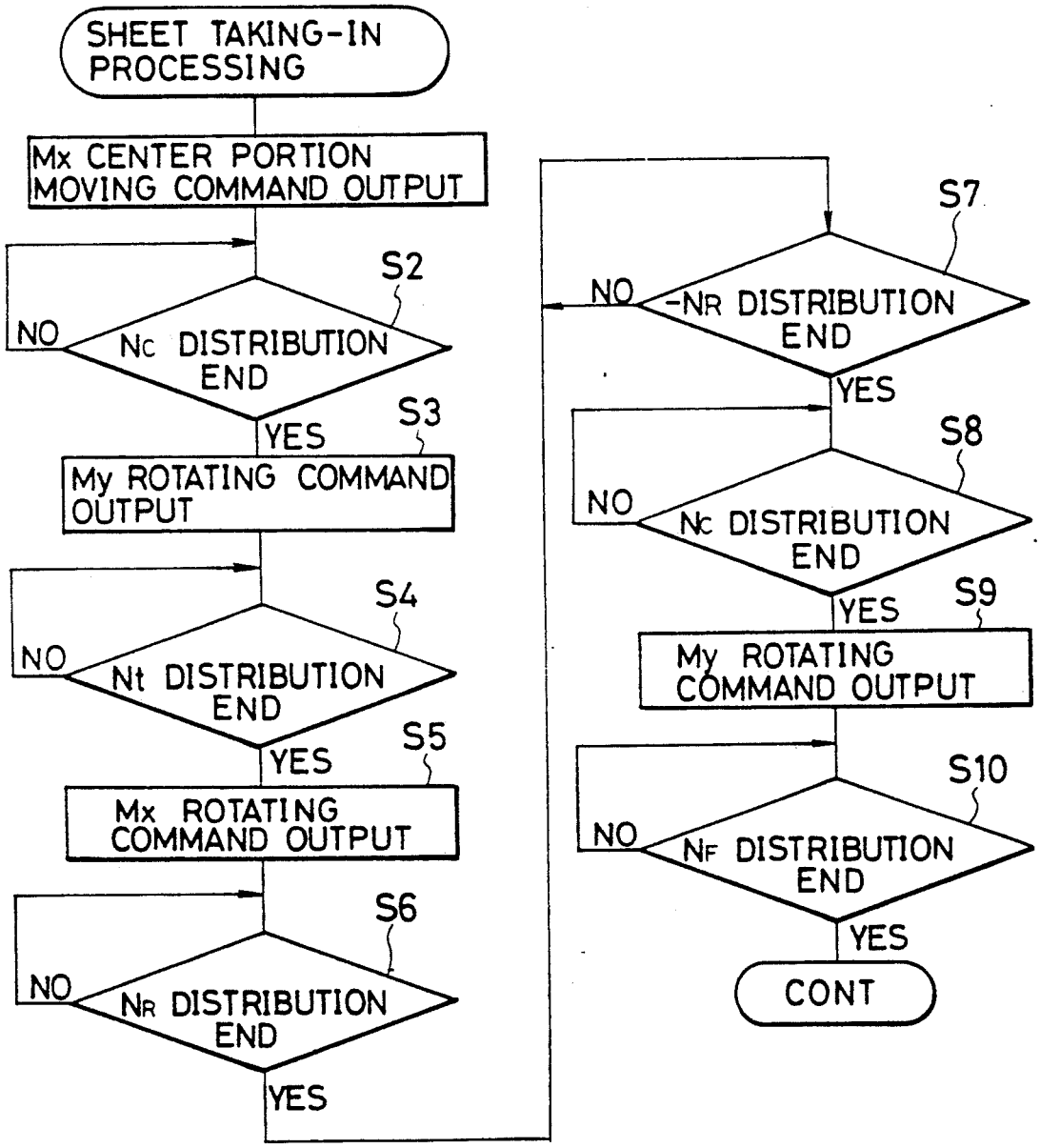
FIG. 6 is a flow chart showing an outline of sheet taking-in processing due to a control unit illustrated in FIG. 1.
Figure 7:
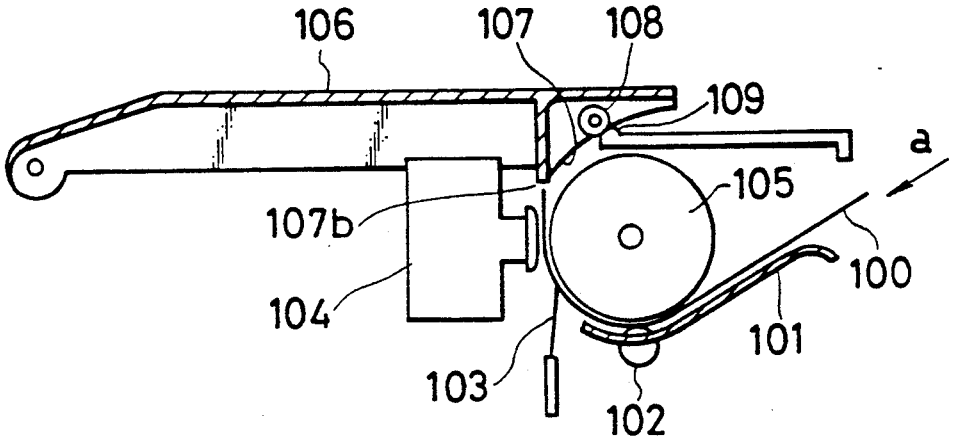
FIG. 7 PRIOR ART
FIG. 7 is a cross-sectional side-elevation view showing an outline of a sheet guide mechanism for a conventional printer.
Figure 8:
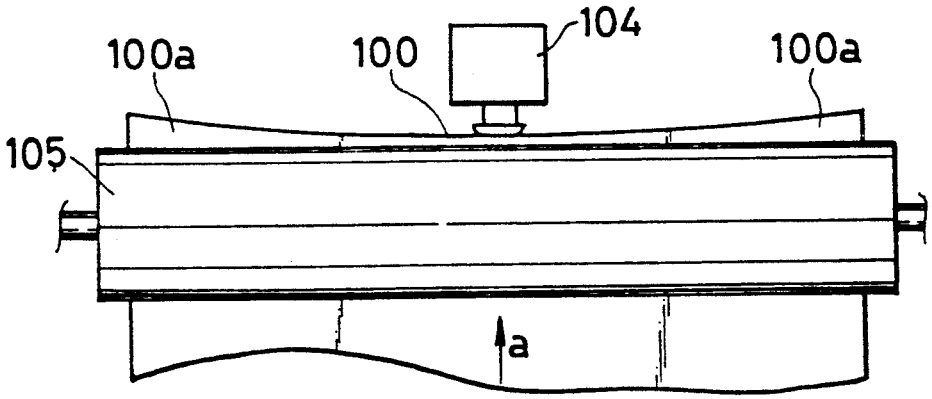
FIG. 8 PRIOR ART
FIG. 8 is a top plan view showing an outline of the sheet guide mechanism for the conventional printer.

FIG. 6 is a flow chart showing an outline of a program of "SHEET TAKING-IN PROCESSING" which is stored in the ROM 33. The "SHEET TAKING-IN PROCESSING" is executed by the CPU 32 at a stage where the forward end of the printing sheet of paper 4 of a cut form inserted in the direction indicated by the arrow a is abutted against the friction roller 5a so that the sheet detecting sensor 24 is operated, or at a stage where the forward end of the printing sheet of paper 4 of a cut form is abutted against the friction roller 5a so that a sheet set switch (not shown) arranged on the printer body is operated (normally, at retry).

Operation of the sheet guide apparatus at the time the printing sheet of paper 4 of the cut form is inserted will hereunder be described.

The CPU 32 initiating or starting "SHEET TAKING-IN PROCESSING" first outputs a center-position moving command to the carriage 9 on the basis of the value $N_C$ of the number of pulses stored in the ROM (Step S1). The CPU 32 initiates distribution of the drive command pulses to the motor drive circuit 31. The CPU 32 drives the head feed motor $M_x$ to move the printing head 6, which is located at the home position (the position $P_1$ in FIG. 4), to the center portion of the platen 1 in the longitudinal direction thereof (the portion $P_2$ in FIG. 4). Thus, it is judged whether or not the distribution processing is completed or ended (Step S2). Simultaneously with the end of the distribution processing, driving of the head feed motor $M_x$ is halted to retain the printing head 6 at the central portion of the platen 1 in the longitudinal direction thereof.

Subsequently, the CPU 32 outputs a rotating command to the sheet feed motor $M_y$ on the basis of the value $N_t$ of the number of pulses stored in the ROM (Step S3). Distribution of the drive command pulses to the motor drive circuit 30 is initiated to rotate the sheet feed motor $M_y$. The platen 1 and the bail roller 2 are driven to transport the forward end of the printing sheet of paper 4 stopped in such a manner that the forward end is in contact with a contact point between the platen 1 and the friction roller 5a at the stage of sheet insertion, to the position where the forward end of the sheet of paper 4 is abutted against the guide element 17. Thus, it is judged whether or not the distribution processing has been ended (Step S4). Simultaneously with the termination or end of the distribution processing, driving of the sheet feed motor $M_y$ is halted.

FIGS. 1, 2A, 2B and 4 show a condition under which the distribution processing has been ended on the basis of the value $N_t$ of the number of pulses, and the forward end of the printing sheet of paper 4 is transported from a gap between the printing head 6 and the platen 1 so that the printing sheet of paper 4 is abutted against the guide element 17. Under this condition, a center portion of the printing sheet of paper 4 at the forward end thereof is guided by the printing head 6, and is engaged with the sheet engaging surface 17a of the guide element 17, which is the largest in an amount of projection, arranged correspondingly to the center waiting position of the printing head 6 moved on the basis of the value $N_C$ of the number of pulses. On the other hand, backward bending occurs on both side portions 4a of the printing sheet of paper 4 at the forward end thereof, which are not supported by the printing head 6, in a direction spaced apart from the platen 1 by a restoring force of the printing sheet of paper 4 per se. Accordingly, if only the platen 1 is driven under the condition as it is to feed the printing sheet of paper 4, the both side portions 4a of the printing sheet of paper 4 at the forward end thereof interfere with the guide elements except for the guide element 17. Thus, there is a case where catching-in occurs.

In view of the above, the CPU 32 outputs a rotating command to the head feed motor $M_x$ on the basis of values $N_R$, $-N_R$ and $N_C$ of the number of pulses stored in the ROM (Step S5). Distribution of the drive command pulses to the motor drive circuit 31 is initiated to rotate the head feed motor $M_x$. The printing head 6 is moved along the axis of the platen 1. First, it is judged whether or not the printing head 6 is moved to the position (Step S6) $P_3$. Subsequently, it is judged whether or not the printing head 6 is moved to the position $P_1$ (Step S7). Lastly, it is judged whether or not the printing head 6 is moved to the position $P_2$ (Step S8). In this manner, the printing head 6 is once reciprocated.

Figure 4:
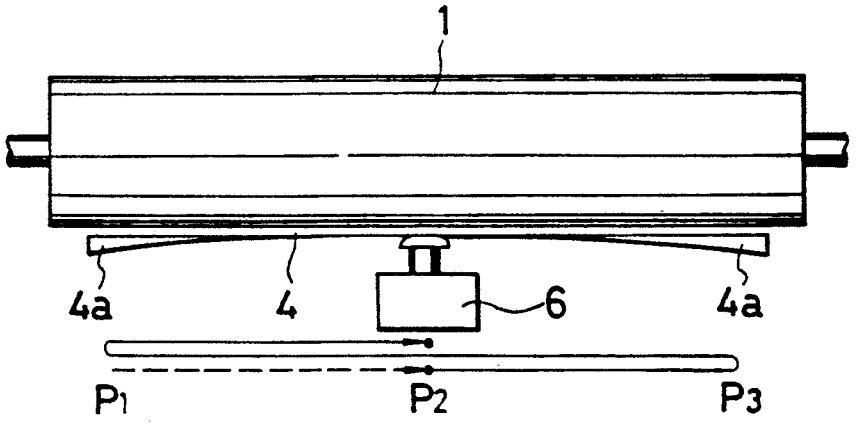
FIG. 4 is a schematic top plan view showing printing-head drive means which forms a part of the sheet guide apparatus illustrated in FIG. 1.

FIG. 4 shows a case where one reciprocating operation of the printing head 6 reaches the home position $P_1$ from the center waiting position $P_2$ through one end $P_3$ of the printing sheet of paper 4 in the widthwise direction and, further, is returned to the center waiting position $P_2$. By this one reciprocating operation, the printing head 6 urges the forward end of the printing sheet of paper 4 abutted against the guide elements at respective positions, against the platen 1 at the respective moving positions. Backward bending at the forward end of the printing sheet of paper 4 is removed so as to prevent interference with the guide elements. The forward end of the printing sheet of paper 4 is engaged successively with the sheet engaging surfaces of the respective guide elements 21 . . . , 18 . . . at respective moving positions. The forward end portion of the printing sheet of paper 4, which passes over the guide elements and which projects toward the printing head 6, is urged toward the platen 1 by the printing head 6, and is limited or restricted in path to a position engaged with the sides of the respective guide elements adjacent to the sheet engaging surfaces thereof. Normally, by one reciprocating operation of the printing head 6 with the center waiting position serving as a start point, the forward end portion of the printing sheet of paper 4 is engaged with the respective sheet engaging surfaces of some of the guide elements located adjacent to the center including the guide elements 21 and 18. At this stage, however, the both sides 4*a* of the printing sheet of paper 4 at the forward end thereof do not reach the sheet engaging surfaces of the respective guide elements 20 and 23.

Then, the CPU 32 outputs the rotating command to the sheet feed motor $M_y$ on the basis of the value $N_F$ of the number of pulses stored in the ROM, to start distribution of the drive command pulses to the motor drive circuit 30 (Step S9). The sheet feed motor $M_y$ is rotated to drive the platen 1 and the ball roller 2. It is judged whether or not the distribution processing has been completed (Step S10). The distribution processing has been completed to feed the printing sheet of paper 4 until the printing position on the first line of the printing sheet of paper 4 reaches the printing head 6, and the forward end of the printing sheet of paper 4 passes through along the sheet engaging surfaces of the respective guide elements. At this stage, the center portion of the printing sheet of paper 4 at the forward end thereof has already been engaged certainly with the sheet engaging surfaces of the respective guide elements 17, 21, 18 and the like. The forward end of the printing sheet of paper 4 is certainly guided by these guide elements 17, 21, 18 and the like, and the sheet engaging surfaces of the respective guide elements 17, 21, 18 and the like further bend the forward end of the sheet of paper 4 toward the platen 1, as the feed operation advances in the passing course or stage. Accordingly, it is prevented that the both sides 4*a* at the forward end are caught in the guide elements.

Hereinafter, the CPU 32, which has completed the "SHEET TAKING-IN PROCESSING" to move the printing sheet of paper 4 to the printing position on the first line, distributes the drive command pulses to the motor drive circuits 30 and 31, on the basis of the control program of the printer, various printing data and the like. The printing wires of the printing head 6 are drivingly controlled, and the normal or usual printing operation is executed.

Furthermore, in the case where the continuous printing sheet of paper 4 is used, the printing sheet of paper 4 is set on the tractor 25 for feeding a continuous sheet of paper, and the sheet set switch is operated, whereby taking-in of the printing sheet of paper 4 is executed.

In this case, the CPU 32 drives the continuous-sheet feed tractor 25 in accordance with operation of the sheet set switch to feed the printing sheet of paper 4, and to move the printing head 6 to the center portion of the platen 1 in the longitudinal direction thereof. The CPU 32 moves the forward end of the printing sheet of paper 4 to the position where the forward end of the sheet of paper 4 is abutted against the guide element 17, on the basis of the detecting signal from the sheet detecting sensor 24 and the value $N_l$, stored in the ROM, to temporarily stop the feeding. The printing head 6 is once reciprocated along the platen axis. The forward end of the printing sheet of paper 4 is engaged with the guide elements. Subsequently, the CPU 32 further moves the printing sheet of paper 4 to the printing position on the first line on the basis of the value $N_F$, of the number of pulses stored in the ROM.

It is also possible to cause the waiting position of the printing head 6 in the "SHEET TAKING-IN PROCESSING", coincide with the home position of the printing head 6 in the normal or usual printing operation. In this case, the guide element in which the amount of projection is maximized is set correspondingly to the home position of the printing head 6.

In place of the fact that, under a condition that the forward end of the printing sheet of paper 4 is abutted against the guide element in which the amount of projection is maximized, the printing sheet of paper 4 stops and is retained to once reciprocate the printing head 6, it is possible that feeding at a low speed is applied to the printing sheet of paper 4 until the forward end of the printing sheet of paper 4 passes through the sheet engaging surfaces of the respective guide elements from the time the forward end of the printing sheet of paper 4 is abutted against the guide element in which the amount of projection is the largest and, during the same, the printing head 6 is once reciprocated or reciprocated through several times along the platen axis.

The control means and the control system are not limited to ones illustrated in FIGS. 5 and 6. Any arrangement may be used, if, at least, the printing head 6 can once be reciprocated along the axis of the platen 1 before or during the time the forward end of the printing sheet of paper 4 fed upwardly from the gap between the printing head 6 and the platen 1 passes through the sheet engaging surfaces of the respective guide elements from the time the forward end of the printing sheet of paper 4 is abutted against the guide elements.

What is claimed is:

1. A sheet guide apparatus for a printer, comprising:

a printing head;

a platen arranged opposite to said printing head;

sheet transporting means arranged upstream of said platen in a sheet delivering direction;

a plurality of guide elements, each with a respective sheet engaging surface, arranged downstream of said platen in said delivering direction, along a longitudinal axis of said platen with said guide elements spaced from a surface of said platen;

printing-head moving means for moving said printing head along said axis of said platen;

a sheet detecting sensor for detecting a forward edge of a sheet; and drive control means for controlling said printing-head moving means such that after said forward end of said sheet transported by said sheet transporting means has been detected as being abutted against one of said sheet engaging surfaces by said sheet detecting sensor, said printing head is reciprocated along said platen axis to cause said forward end of said sheet to be sequentially brought to abut against remaining ones of said sheet engaging surfaces.

2. A sheet guide apparatus for a printer, according to claim 1, wherein said guide elements are arranged such that an amount of projection of said one guide element at a center of said platen along said axis thereof is the largest, and said amount of projection of said remaining guide elements is gradually reduced depending upon a distance from said center.

3. A sheet guide apparatus for a printer, according to claim 2, wherein said drive control means for controlling said printing-head moving means moves said printing head to a center portion of said platen along said axis thereof when said sheet detecting sensor is operated and, subsequently, abuts said forward end of said sheet against said sheet engaging surfaces.

4. A sheet guide apparatus for a printer, according to claim 3, wherein said drive control means for controlling said printing-head moving means moves said printing head from said center portion of said platen along said axis thereof to one end of said platen and, subsequently, moves said printing head to the other end of said platen and, subsequently, moves said printing head to said center portion of said platen.

5. A sheet guide apparatus for a printer, according to claim 1, wherein said guide elements are arranged such that an amount of projection of said one guide element is the largest at one end of said platen along said axis thereof, and said amount of projection of said remaining guide elements is gradually reduced in accordance with a distance from said one end of said platen.

6. A sheet guide apparatus for a printer, according to claim 5, wherein said drive control means for controlling said printing-head moving means moves said printing head from said one end to the other end along said axis and, again moves said printing head to said one end.

* * * * *